US008113403B2

(12) United States Patent
Tanaka et al.

(10) Patent No.: US 8,113,403 B2
(45) Date of Patent: Feb. 14, 2012

(54) GAS INTERNAL COMBUSTION TYPE NAILING MACHINE

(75) Inventors: Hiroshi Tanaka, Tokyo (JP); Hajime Takemura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 12/594,237

(22) PCT Filed: Mar. 28, 2008

(86) PCT No.: PCT/JP2008/056132

§ 371 (c)(1),
(2), (4) Date: Oct. 1, 2009

(87) PCT Pub. No.: WO2008/120731

PCT Pub. Date: Oct. 9, 2008

(65) Prior Publication Data

US 2010/0108735 A1 May 6, 2010

(30) Foreign Application Priority Data

Apr. 2, 2007 (JP) ..... 2007-096165
Apr. 27, 2007 (JP) ..... 2007-118818

(51) Int. Cl.
*B25C 1/08* (2006.01)

(52) U.S. Cl. ..... 227/10; 227/9; 227/11

(58) Field of Classification Search ..... 227/9, 10, 227/11, 156

See application file for complete search history.

(56) References Cited

U.S. PATENT DOCUMENTS

| | | | | |
|---|---|---|---|---|
| 4,403,722 | A | 9/1983 | Nikolich | |
| 4,483,280 | A * | 11/1984 | Nikolich | 123/46 SC |
| 4,483,473 | A * | 11/1984 | Wagdy | 227/8 |
| 4,483,474 | A * | 11/1984 | Nikolich | 227/8 |
| 4,522,162 | A * | 6/1985 | Nikolich | 123/46 SC |
| 5,909,836 | A * | 6/1999 | Shkolnikov et al. | 227/8 |
| 6,755,159 | B1 | 6/2004 | Adams et al. | |
| 7,556,182 | B2 * | 7/2009 | Murayama et al. | 227/10 |
| 2005/0218179 | A1 * | 10/2005 | Akiba et al. | 227/10 |
| 2008/0314951 | A1 * | 12/2008 | Kosuge et al. | 227/10 |
| 2009/0071999 | A1 * | 3/2009 | Tamura et al. | 227/10 |

FOREIGN PATENT DOCUMENTS

| | | |
|---|---|---|
| CN | 1517184 A | 8/2004 |
| JP | 4-48589 | 8/1992 |
| JP | 8-290370 | 11/1996 |
| JP | 2004-299043 | 10/2004 |
| JP | 2006-000946 | 1/2006 |
| JP | 2006-224268 | 8/2006 |

* cited by examiner

*Primary Examiner* — Brian D Nash
(74) *Attorney, Agent, or Firm* — Drinker Biddle & Reath LLP

(57) ABSTRACT

In a gas internal combustion type nailing machine, a tubular-shaped sleeve is fixed between a movable housing and a fan. Between the movable housing and sleeve, an annular space portion is formed. In such portions of the sleeve as existing respectively upwardly and downwardly of the fan, there are formed communication holes and in communication with the annular space portion. Mixed gas blown out by the fan flows through the lower communication hole and returns from the annular space portion to the combustion chamber through the upper communication hole.

6 Claims, 6 Drawing Sheets

GAS INTERNAL COMBUSTION TYPE NAILING MACHINE

TECHNICAL FIELD

The present invention relates to a nailing machine of a gas internal combustion type which is used to drive a nail such as an ordinary nail and a drive screw and, specifically, the invention relates to an improved structure of a combustion chamber formed in such nailing machine.

BACKGROUND ART

Conventionally, there has been already known well a gas internal combustion type nailing machine (for example, see the patent reference 1) structured in the following manner: that is, a combustion chamber formed in the nailing machine includes a movable housing portion, and the movable housing portion can be opened and closed in linking with the operation of a contact member; in the closed state of the combustion chamber, combustible gas is supplied into the combustion chamber, the combustible gas and air are mixed together thereby rotating a fan, the thus mixed gas is ignited using a spark plug and is thereby combusted explosively, and the resultant high gas pressure is applied onto a striking piston to thereby drive a nail; and, in the opened state of the combustion chamber, the air is sucked and is discharged from the lower portion of a striking cylinder.

In the combustion chamber, in order to mix together the combustible gas and air quickly, the mixed gas must be stirred up at a high speed. In this case, when the flow speed of the mixed gas is high, the mixed gas is sometimes hard to be ignited even when the spark plug is operated for ignition. In view of this, it is known that there is formed a special block wall in the periphery of the spark plug (for example, see the patent reference 2).

[Patent Reference 1] JP-B-04-048589

[Patent Reference 2] JP-A-2006-224268

Here, in the above-mentioned well-known gas internal combustion type nailing machine, when driving the fan for stirring the mixed gas within the combustion chamber, in the vicinity of the central portion of the lower portion of the fan, there is formed a stagnant portion where the flow of the mixed gas is weak and the gas combustion speed is thereby retarded. This can raise a fear that the mixed gas can be combusted incompletely to degrade the combustion efficiency of the mixed gas. Also, since a guide and a seal respectively used for the operation of the movable housing of the combustion chamber are formed as separate parts which are disposed in the upper and lower portions of the movable housing, they are easy to differ in the axis thereof from each other, which raises a fear that the operation load of the movable housing of the combustion chamber can increase and the poor sealing of the movable housing can occur.

Further, since the upper and lower portions of the movable housing of the combustion chamber are different in the sealing diameter thereof from each other, such pressure within the combustion chamber as is influenced by the combustion pressure and supercharged pressure causes an unbalanced load within the combustion chamber to thereby generate an operation load there. Specifically, the load caused by the combustion pressure has an influence on the mechanical strength of the combustion chamber, whereas the load caused by the supercharged pressure can raise a fear that, after the air is supercharged, the combustion chamber is moved up to its upper position and is left unmoved there, whereby the combustion chamber cannot be opened.

SUMMARY OF INVENTION

One or more embodiments of the invention provide a gas internal combustion type nailing machine structured such that, inside a movable housing provided in a combustion chamber, there is disposed a substantially straight tubular-shaped sleeve which extends between an upper end of a striking cylinder and an upper portion of the combustion chamber, whereby a flow of a mixed gas can be stirred effectively by a fan and also the stirred mixed gas can be ignited positively.

Also, one or more embodiments of the invention provide a gas internal combustion type nailing machine in which provision of the above-mentioned sleeve allows the movable housing and a head valve to operate independent of each other in such a manner that they do not interfere with each other.

According to one or more embodiments of the invention, a gas internal combustion type nailing machine is provided with: a striking cylinder for slidably accommodating a striking piston therein; a tubular-shaped movable housing; a combustion chamber disposed in an upper side of the striking cylinder and configured to be opened and closed by the movable housing; a fan disposed in a central portion of the combustion chamber; a tubular-shaped sleeve interposed between the movable housing and the fan, and fixed to a main body of the nailing machine; and communication portions respectively provided on portions of the sleeve in an upper side and a lower side of the fan, and configured to communicate the combustion chamber with an annular space portion formed between the movable housing and the sleeve.

According to the above-mentioned gas internal combustion type nailing machine, the sleeve is fixedly interposed between the movable housing and fan, and the annular space portion is formed between the movable housing and fan; and also, the communication portions respectively in communication with the annular space portion are formed in such portions of the sleeve that exist upwardly and downwardly of the fan, whereby the mixed gas blown out by the fan is allowed to flow through the lower communication portion and return to the combustion chamber through the upper communication portion. Owing to this, since the flow of the mixed gas generated by the fan can be forcibly changed by the sleeve with the communication portions, the mixed gas in a stagnant portion, which is easy to occur in the central lower portion of the fan and in which the flow of the mixed gas is weak, can be forcibly dispersed and mixed up, whereby the lowered combustion efficiency due to the otherwise possible incomplete combustion of the mixed gas can be prevented.

Also, the above gas internal combustion type nailing machine may further include: a separation portion which is formed between the combustion chamber and striking cylinder, and also which includes a valve structured such that, when the pressure on the combustion chamber side is high, it can be closed and, when the pressure on the striking cylinder side is high, it can be opened; a downward extended portion formed in such portion of the lower portion of the sleeve as existing downwardly of the separation portion; an opening formed in the downward extended portion and situated at a position corresponding to a supply port formed in the upper end side wall of the striking cylinder; and, a ring-shaped head valve interposed vertically movable between the striking cylinder and the downward extended portion of the sleeve for opening and closing the supply port and opening. Also, the head valve may be urged in the closing direction and can be opened by the combustion pressure of the mixed gas existing within the combustion chamber.

When, in such portion of the lower portion of the sleeve as existing downwardly of the partition portion, there is formed the downward extended portion, in the downward extended portion, there is formed an opening at a position corresponding to the supply port formed in the upper end side wall of the striking cylinder, between the striking cylinder and the downward extended portion of the sleeve, there is interposed the ring-shaped head valve which can be moved in the vertical direction and also can be used to open and close the supply port and opening, and the head valve is normally urged in the closing direction and also can be opened using the combustion pressure of the mixed gas existing within the combustion chamber, since the sleeve is interposed between the movable housing and head valve, the movable housing and head valve do not interfere with each other but can be operated independent of each other, thereby being able to stabilize the operation of the nailing machine.

Also, the tubular-shaped sleeve of the combustion chamber may also be disposed adjacent to the rotary vane of the fan.

When the tubular-shaped sleeve of the combustion chamber is disposed adjacent to the rotary vane of the fan, the mixed gas discharged in the diameter direction of the outer periphery of the rotary vane of the fan due to the rotation of the rotary vane forms a forced quick flow going in the axial direction, and thus the mixed gas existing in the stagnant portion easy to occur in the central lower portion of the fan and weak in the flow rate can be dispersed and mixed up well, which can facilitate the uniform stirring of the mixed gas. This can prevent the incomplete combustion of the mixed gas and thus can enhance the combustion efficiency of the mixed gas.

Also, the sleeve may also be used to guide the operation of the movable housing.

When the sleeve fixed to the main body of the nailing machine is used to guide the operation of the movable housing, the movable housing can be stably supported with no axis shifted and can be moved up and down smoothly and positively. This can reduce the operation load of the movable housing and also can prevent the poor sealing of the movable housing.

Also, the upper and lower seal diameters of the movable housing may also be substantially equal to each other.

When the upper and lower seal diameters of the movable housing are set substantially equal to each other, with respect to the movable housing, there cannot be generated a load due to a difference between the sealing diameters caused by the combustion pressure when the mixed gas within the combustion chamber is combusted. This can prevent the occurrence of a state in which the movable housing is moved up and left unmovable there due to the generation of a partial load with respect to the movable housing possibly caused by the influence of the supercharged pressure or the like within the combustion chamber, and the occurrence of a state in which the movable housing cannot be opened.

Also, such portion of the communication portion as is nearest to the spark plug may also be shielded.

When such portion of the communication portion as is nearest to the spark plug is shielded, although the speed of the flow of the mixed gas is increased, since the block portion is formed in the vicinity of the spark plug, the gas flow speed in this portion is reduced. This makes it sure to ignite the mixed gas, thereby being able to enhance the ignition performance. Also, the block portion may be formed in the sleeve, which can eliminate the need to form the block portion separately from the sleeve.

Other aspects and advantages of the invention will be apparent from the following description, the drawings and the claims.

BRIEF DESCRIPTION OF DRAWINGS

Brief Description of the Drawings

Figure 1:
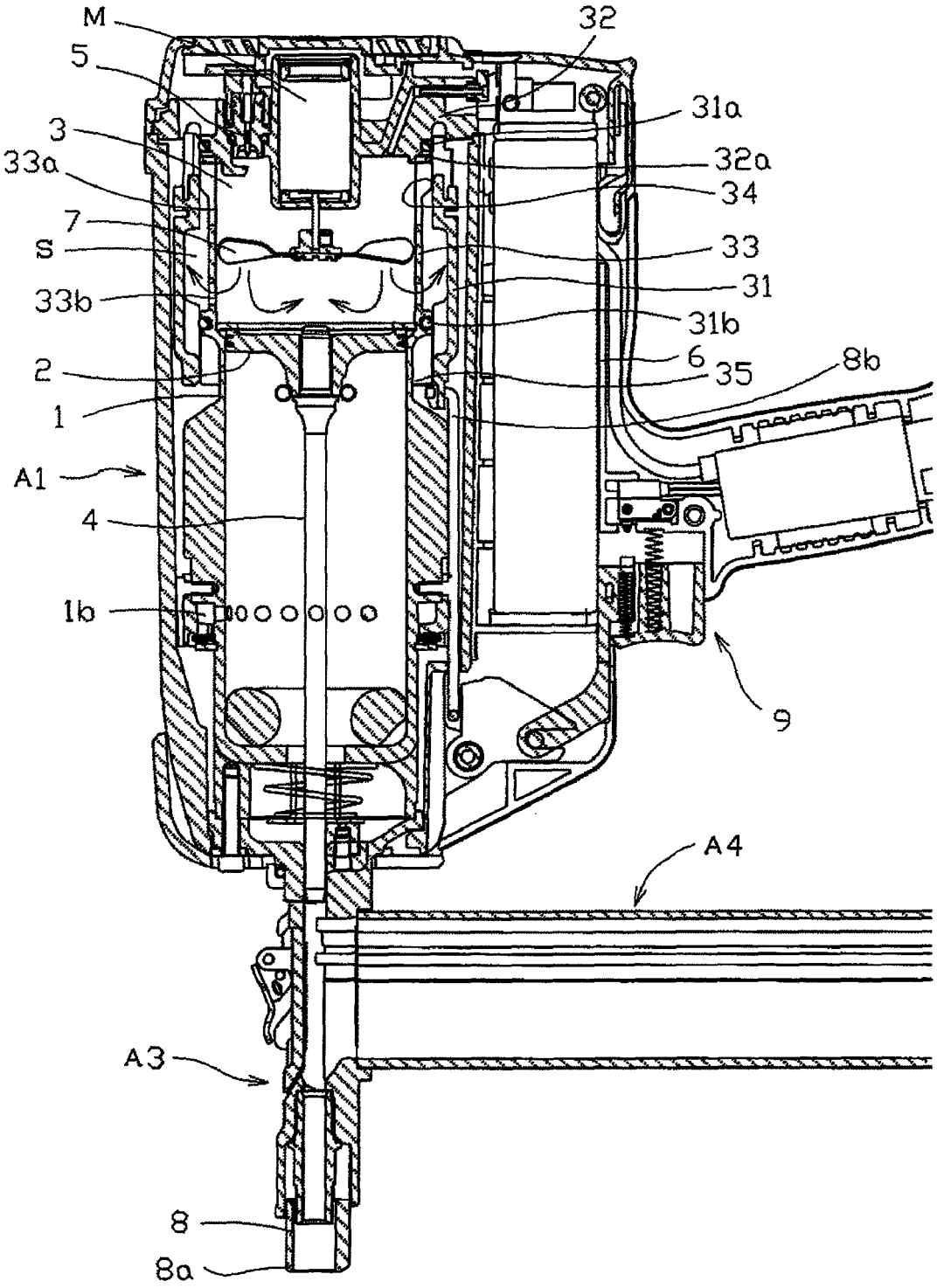

FIG. 1 is a longitudinal section view of the main portions of a gas internal combustion type nailing machine according to a first exemplary embodiment of the invention.

Figure 2:
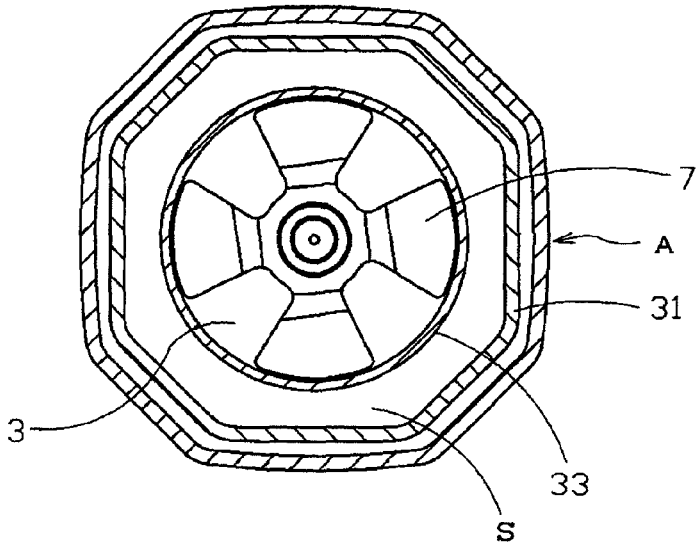

FIG. 2 is a transverse section view of a combustion chamber portion of the first exemplary embodiment of the invention.

Figure 3:
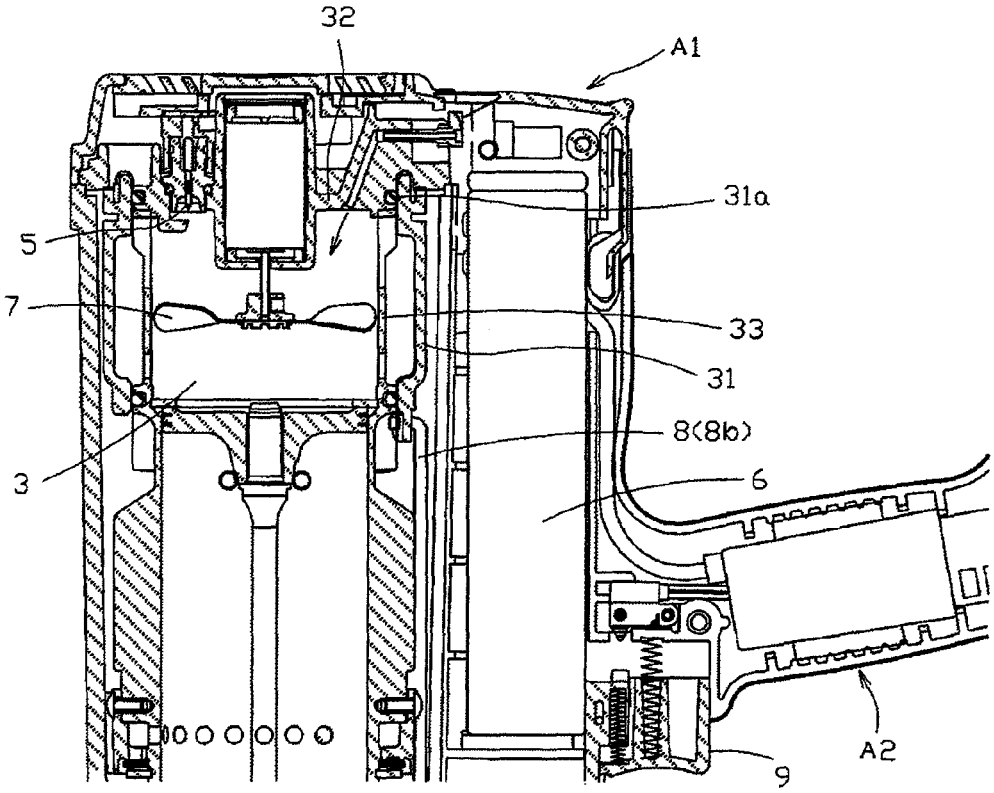

FIG. 3 is an enlarged section view of the first exemplary embodiment of the invention, showing a state where a combustion chamber is closed.

Figure 4:
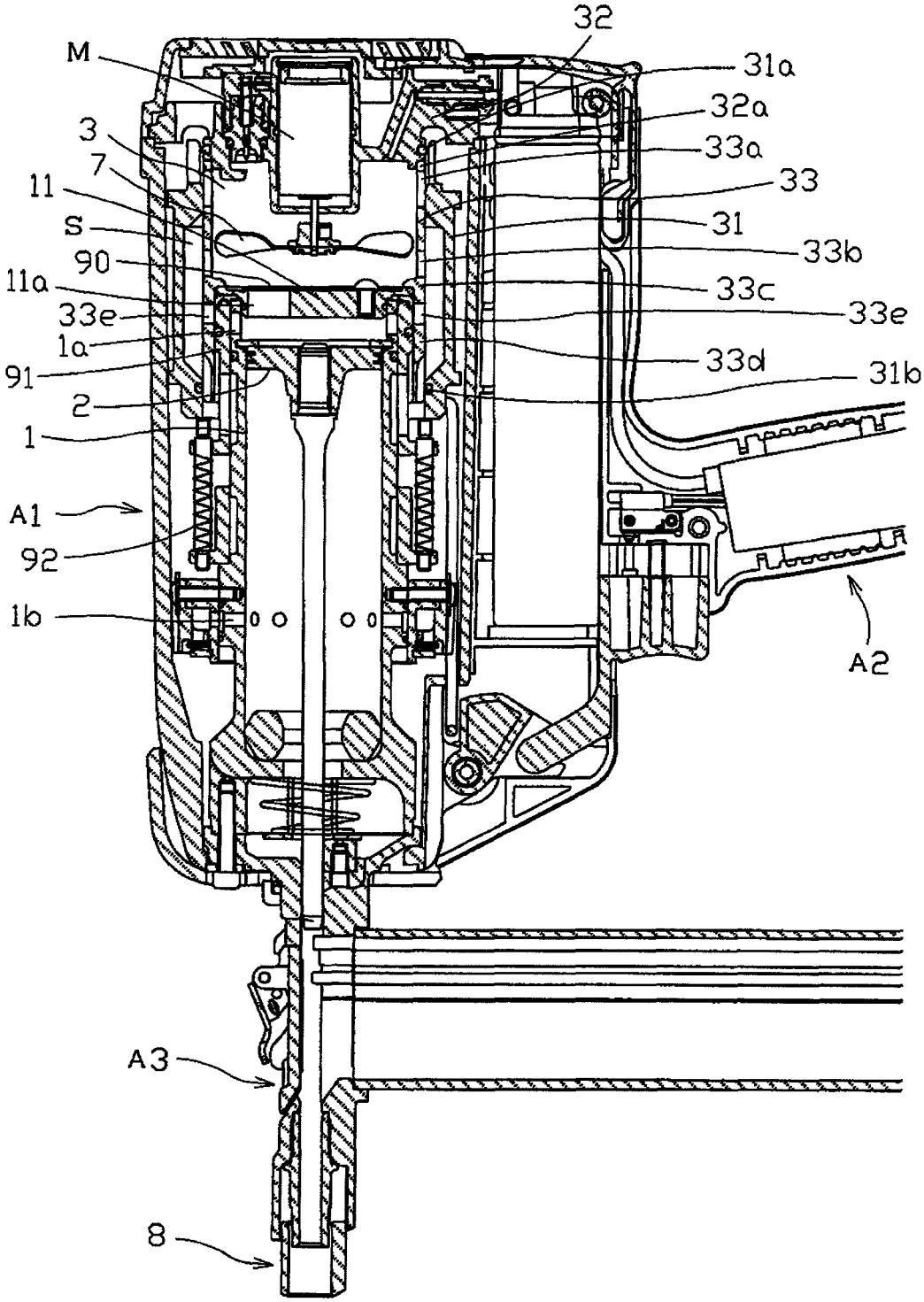

FIG. 4 is a longitudinal section view of the main portions of a gas internal combustion type nailing machine according to a second exemplary embodiment of the invention.

Figure 5:
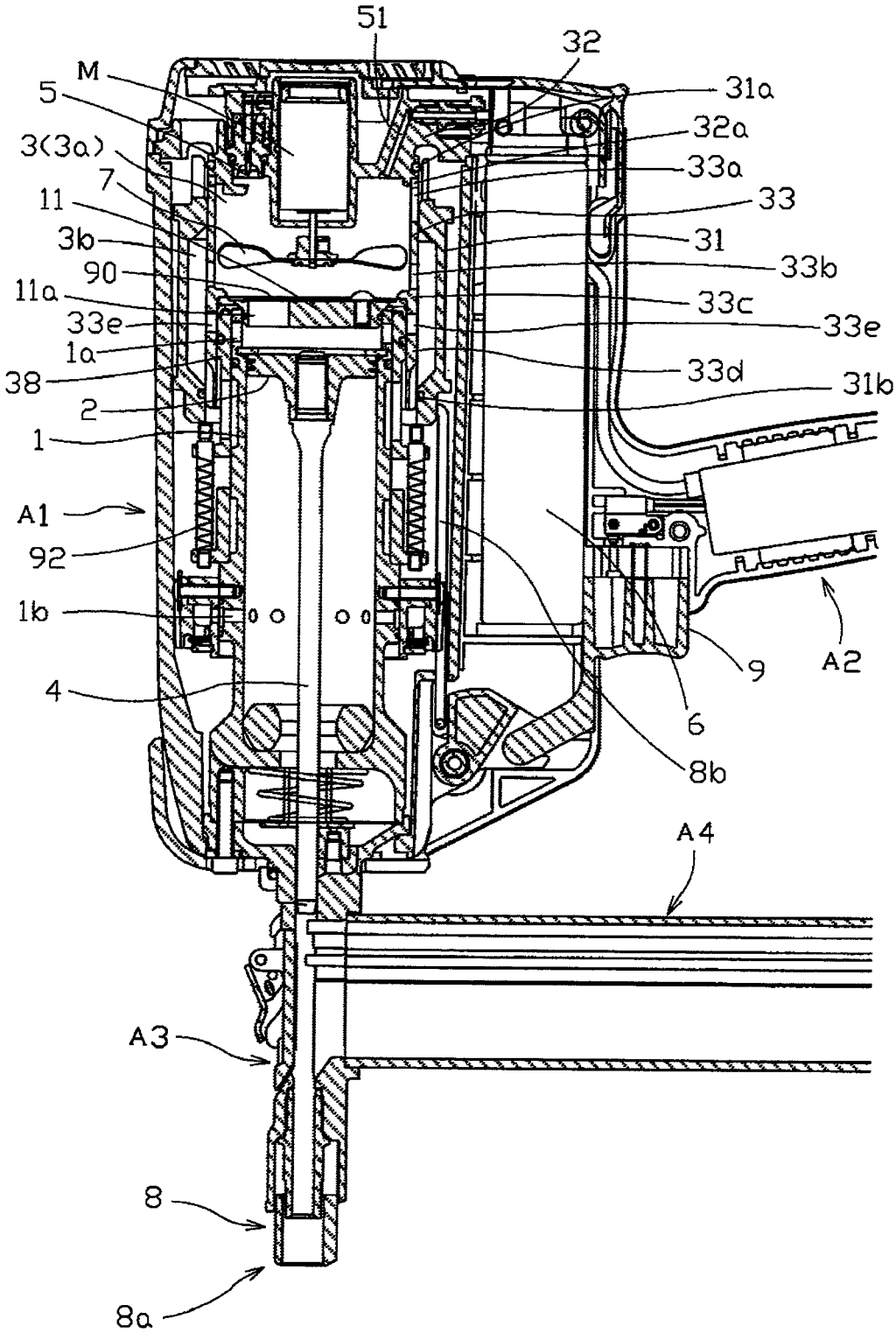

FIG. 5 is a longitudinal section view of the main portions of a gas internal combustion type nailing machine according to a third exemplary embodiment of the invention.

Figure 6:
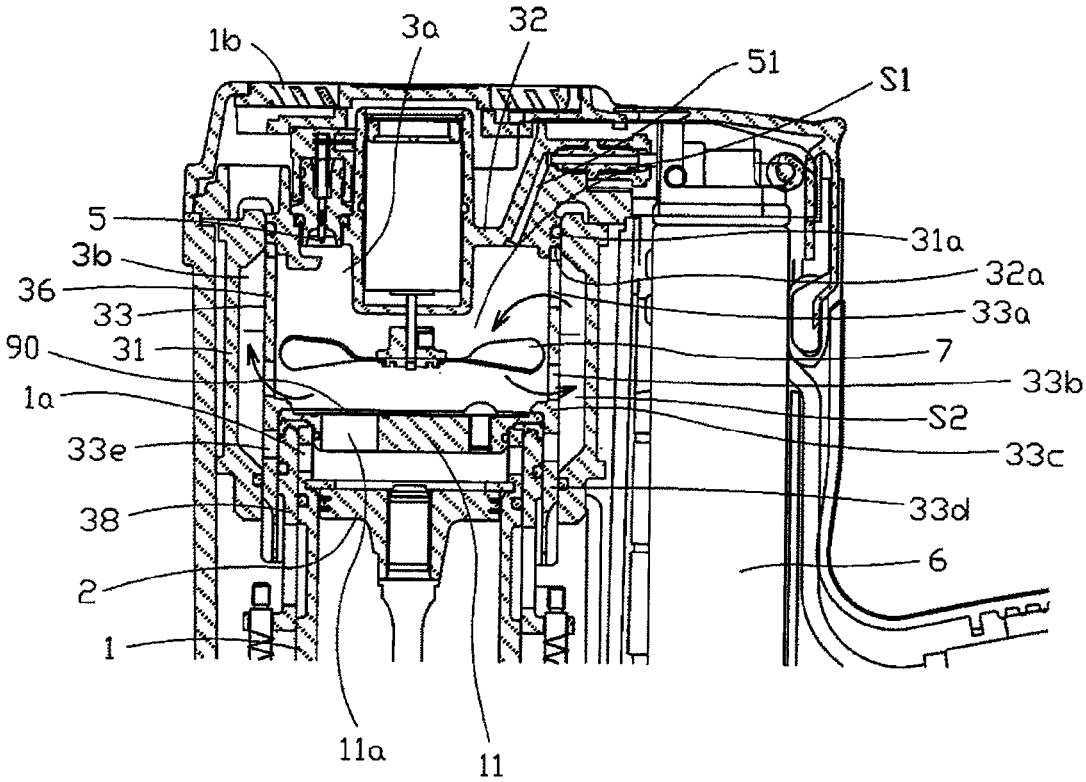

FIG. 6 is an enlarged section view of the third exemplary embodiment of the invention, showing a state where a combustion chamber is closed.

Figure 7:
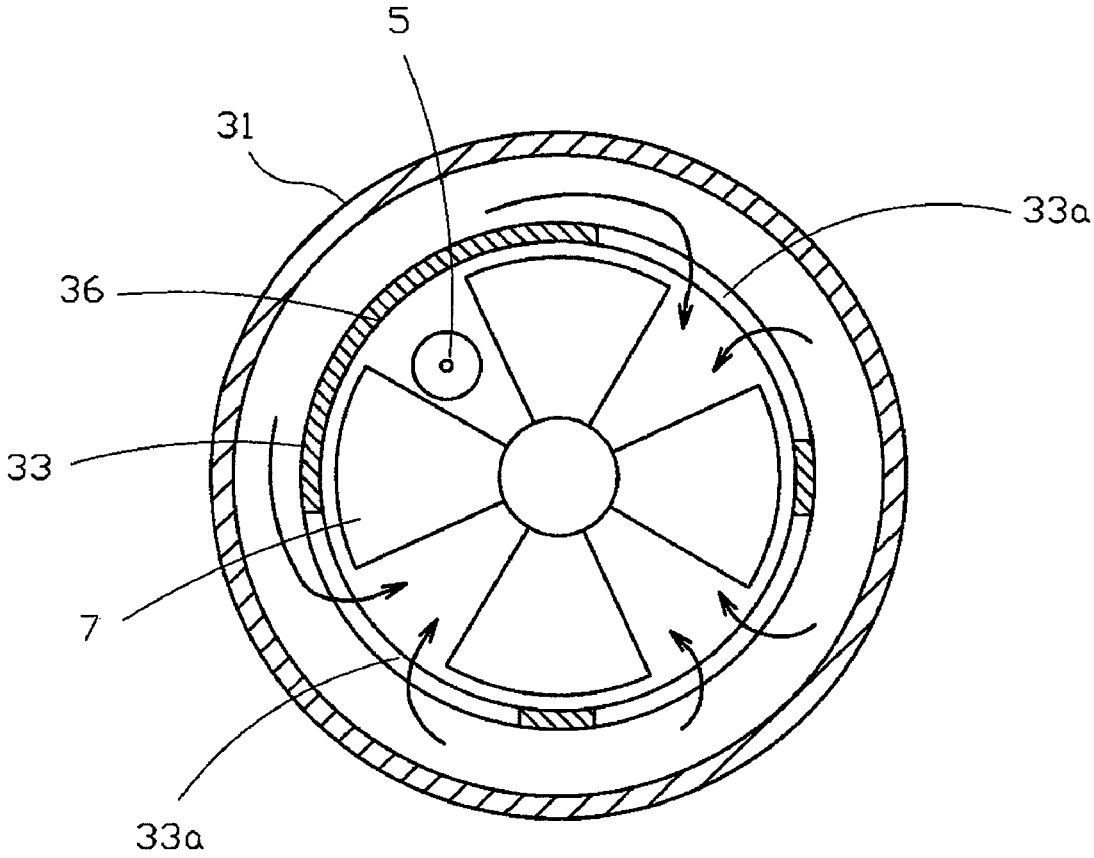

FIG. 7 is a transverse section view of a combustion chamber portion of the third exemplary embodiment of the invention.

DESCRIPTION OF REFERENCE NUMERALS AND SIGNS

A: Gas internal combustion type nailing machine
1: Striking cylinder
2: Striking piston
3: Combustion chamber
31: Movable housing
32: Cylinder head portion
33: Sleeve
33*a*, 33*b*: Communication hole (Communication portion)
7: Fan
36: Block portion

BEST MODE FOR CARRYING OUT THE INVENTION

Now, description will be given below of a gas internal combustion type nailing machine according to exemplary embodiments of the invention with reference to the accompanying drawings.

First Exemplary Embodiment

Here, description will be given below of a first exemplary embodiment according to the invention with reference to FIGS. 1 to 3.

FIGS. 1 and 2 respectively show a gas internal combustion type nailing machine A. This nailing machine A includes: a nailing machine main body A1 for accommodating therein a drive mechanism portion, a gas fuel cartridge and the like; a grip A2 formed integrally with the nailing machine main body A1; a nose portion A3 having a mounting portion for mounting a magazine A4 projecting from the lower portion (in FIG. 1) of the nailing machine main body A1; and, other composing elements.

The drive mechanism portion to be accommodated into the nailing machine main body A1 includes: a cylindrical-shaped striking cylinder 1; a striking piston 2 which can be reciprocatingly moved in the vertical direction (in FIG. 1) within the striking cylinder 1; a combustion chamber 3 formed of a space which is surrounded by a tubular-shaped movable housing 31 and an upper cylinder head portion 32 respectively disposed in the upper portion of the striking cylinder 1, and also which is divided by the upper surface of the striking piston 2; a driver 4 fixed to the striking piston 2; a spark plug 5 mounted on the cylinder head portion 32 situated upwardly of the combustion chamber 3; a stirring fan 7 which, when it is driven by a motor M, can mix combustible gas supplied from a gas fuel cartridge 6 with the air; and, other parts.

Also, there is further provided a contact member 8 which carries out initial motion for substantially starting the drive mechanism portion. The contact member 8 is structured in the following manner: that is, in a state where the nailing machine is not applied to a nailing operation, the lower end 8*a* of the contact member 8 is urged by a spring to project from the lower-most portion of the nose portion A3, and the upper end 8*b* of a rod member connected to the contact member 8 is connected to the lower end portion of the movable housing 31, whereby the movable housing 31 of the combustion chamber 3 is moved down to the lower position thereof to open an upper O ring 31*a* (which will be discussed later) for sealing the upper portion of the movable housing 31.

As shown in FIG. 3, when the contact member 8 is pushed in upwardly, the movable housing 31 of the combustion 3 is moved up to the upper position thereof to thereby close the upper O ring 31*a*; and also, in linking with the operation of a trigger lever 9, the gas fuel is supplied, the mixed gas is ignited using the spark plug 5, and other related operations are carried out.

Thus, when the contact member 8, which is pressed against a member to be nailed (not shown), is relatively pushed into the combustion chamber 3 in the upward direction, the tubular-shaped movable housing 31 of the combustion chamber 3 is moved up to its upper position to thereby turn the combustion chamber 3 from the open state into the sealed and closed state; and also, the gas fuel is injected and supplied from the gas fuel cartridge 6 into the combustion chamber 3 through the fuel supply passage of the upper cylinder head portion 32 of the combustion chamber 3, the air and gas fuel are stirred and mixed up uniformly by driving the stirring fan 7, and a trigger switch is turned on by pushing in a trigger lever 9 to ignite the spark plug 5, whereby the mixed gas within the combustion chamber 3 is exploded and combusted.

The high combustion pressure caused by the combustion of the mixed gas within the combustion chamber 3 is applied to the upper portion of the striking piston 2 to move down the striking piston 2 and thus the driver 4 fixed to the striking piston 2. Due to the downward movement of the driver 4, the driver 4 strikes the head portion of a nail which is supplied from the magazine A4 into the nose portion A3, whereby this nail can be driven into a given position of the member to be nailed.

Also, when the striking piston 2 is moved down to the bottom dead center thereof, the temperature of the combustion gas that has been expanded suddenly within the striking cylinder 1 is lowered suddenly, whereby the striking piston 2 is moved up and returned to the top dead center thereof.

And, as the operation of the trigger lever 9 is released just before or after the above-mentioned operation and the nailing operation is thereby ended, the contact member 8 is released from the pressure against the member to be nailed. Thus, the contact member 8 is pushed down due to the return force of a spring and is thereby moved down to its lower position. The downward movement of the contact member 8 moves down the movable housing 31 of the combustion chamber 3 to thereby open the movable housing 31 and the upper O ring 31*a* of the upper cylinder head portion 32 of the combustion chamber 3; and, the fresh air is allowed to flow into the combustion chamber 3 from the thus opened O ring 31*a*.

That is, the gas internal combustion type nailing machine A has substantially the same structure as described above.

Here, description will be given below in detail of the structure of the combustion chamber 3 with reference to FIGS. 1 and 2. Inside the movable housing 3 of the combustion chamber 3 that is surrounded by the tubular-shaped movable housing 31 and cylinder head portion 32, there is provided a tubular-shaped sleeve 33 which is used to separate the combustion chamber 3; and, between the sleeve 33 and movable housing 31, there is formed an annular space portion S.

The sleeve 33 is made of a substantially straight tubular member which is extended from the upper end of the striking cylinder 1 and the inside diameter of which is set slightly larger than the inside diameter of the striking cylinder 1; and, the upper end of the sleeve 33 is fitted with and fixed to a ring-shaped step portion 32*a* disposed just below the upper O ring 31*a* of the cylinder head portion 32. Also, in the upper and lower portions of the peripheral wall of the sleeve 33, there are formed communication holes (communication portions) 33*a*, 33*b* through which the mixed gas is allowed to flow, respectively. The relatively wide peripheral surface of the peripheral wall intervening between the communication holes 33*a* and 33*b* is formed opposed to and close to the outer periphery of the rotary vane of the stirring fan 7.

The sleeve 33 is structured as follows: that is, it is arranged concentrically with and is spaced by a given distance from the tubular-shaped movable housing 31 that is situated outside the sleeve 33; and, the upper and lower outer peripheral walls 34 and 35 of the sleeve 33 can be slidingly contacted with the upper and lower peripheral walls of the movable housing 31. Thanks to this structure, when the movable housing 31 is guided by the sleeve 33, it can be operated stably in the vertical direction.

Also, the upper and lower O rings 31*a* and 31*b* disposed on the sleeve 33 made of a tubular-shape member are formed such that they have the same diameter, whereby the upper and lower sealing diameters of the movable housing 31 are equal to each other.

According to the combustion chamber structure having the above arrangement, since the sleeve 33 substantially formed as the extended portion of the striking cylinder 1 guides the sliding movement of the movable housing 31 of the combustion chamber 3 through the upper and lower outer peripheral walls 34 and 35 of the peripheral wall thereof, the upper and lower O rings 31*a* and 31*b* can be prevented from shifting in the axis thereof from each other. Owing to this, the vertical movement of the movable housing 31 can be executed smoothly and positively, and the operation load of the movable housing 31 can be reduced, whereby the poor sealing of the movable housing 31 by the O rings 31*a* and 31*b* can be prevented effectively.

Also, since the sleeve 33 is made of a straight tubular-shaped member and thus the upper and lower O rings 31*a* and 31*b* of the movable housing 31 of the combustion chamber 3 are equal in diameter to each other, a load, which is based on the seal diameter difference that can be caused by a combustion pressure at the time when the mixed gas is combusted within the combustion chamber, can be prevented from being generated with respect to the movable housing 31. Therefore, when a mechanism for applying a supercharging pressure is provided within the combustion chamber, it is possible to prevent the occurrence of an unfavorable phenomenon that a partial load is generated in the movable housing 31 due to the influence of the supercharging pressure to thereby leave the movable housing 31 at its upper position after it moves up there, or a phenomenon that the movable housing 31 cannot be opened.

And, since the peripheral wall of the sleeve 33 is disposed adjacent to the rotary vane of the stirring fan 7, the mixed gas, which is guided outwardly in the diameter direction by the fan 7, is shielded by the peripheral wall of the sleeve 33 to provide a flow (see arrow marks shown in FIG. 1) forced to go downward in the axial direction of the combustion chamber 3; this mixed gas, while catching positively the air stagnating in the vicinity of the lower center of rotation of the rotary vane, flows out from the lower communication hole 33*b* of the sleeve 33 and flows into a space between the sleeve 33 and movable housing 31; and, the mixed gas, which has flowed into the space between the sleeve 33 and movable housing 31, moves upwardly within the space and forms the mixed gas that flows into behind the rotary vane of the stirring fan 7. This flow of the mixed gas can facilitate the dispersive mixture of the air and gas fuel further, which can promote the unified mixture thereof effectively. This can prevent the occurrence of the imperfect combustion of the mixed gas and thus can enhance the combustion efficiency thereof.

Second Exemplary Embodiment

FIG. 4 shows an improved structure (according to a second exemplary embodiment of the invention) of a combustion chamber for use in a gas internal combustion type nailing machine of a head valve type. This gas internal combustion type nailing machine A is basically similar in structure to the gas internal combustion type nailing machine according to the first exemplary embodiment of the invention and thus the duplicate description of the structure portions thereof in common with the first exemplary embodiment is in principle omitted here.

The present combustion chamber 3 includes on the upper end of the striking cylinder 1: a separation portion 11 for separating the interior portion of the striking cylinder 1 and the interior portion of the combustion chamber 3 from each other; and, a check valve 90 for opening and closing a penetration hole 11*a* formed in the separation portion 11.

The check valve 90, which is made of a plate spring, is structured such that it is normally urged by a spring to close the interior portion of the combustion chamber 3 and the interior portion of the striking cylinder 1 with respect to each other and, only when the internal pressure of the interior portion of the striking cylinder 1 is higher than the internal pressure of the interior portion of the combustion chamber 3, can open the interior portion of the combustion chamber 3 and the interior portion of the striking cylinder 1 relative to each other.

The lower inside fixed portion 33*c* of the sleeve 33 is fitted with and fixed to the outer periphery of the separation portion 11 fixed to the upper end of the striking cylinder 1, and the upper end of the sleeve 33 is fitted with and fixed to the ring-shaped step portion 32*a* of the cylinder head 32, whereby the annular space portion S formed inside the tubular-shaped movable housing 31 of the combustion chamber 3 is formed such that it is extended further downwardly than the space portion S shown in FIG. 1.

Next, in the upper end side walls of the striking cylinder 1, there are formed supply ports 1*a* and, in correspondence to them, in the lower extension portions 33*d* of the sleeve 33, there are opened up openings 33*e*, respectively. And, between the striking cylinder 1 and sleeve 33, there is interposed a ring-shaped head valve 91 which can be moved in the vertical direction in order that it can communicate the supply port 1*a* and opening 33*e* with each other or can cut off them from each other.

The head valve 91 is disposed such that it can be moved in the vertical direction along the upper outside surfaces of the striking cylinder 1 and also along the inner peripheral surfaces of the extension portions 33*d* extended further downwardly of the lower inside fixed portions 33*c* of the sleeve 33. The head valve 91 is also urged upwardly by a spring 92 provided on the lower portion thereof in such a manner that it can normally close the supply port 1*a*. The spring force of the spring 92 is set to such a degree that, when the internal pressure of the interior portion of the combustion chamber 3 is increased by combustion, it cannot hold the head valve 91 in the closed state thereof.

Here, the O rings 31*a* and 31*b* respectively for sealing the upper and lower portions of the movable housing 31 are almost equal in diameter to each other.

Also, the sleeve 33, which is used to guide the vertical movements of the movable housing 31, similarly to the embodiment shown in FIG. 1, is structured such that it is disposed adjacent to the rotary vane of the fan 7.

Next, description will be given below of the operation of the present nailing machine. That is, when driving a nail, as the contact member 8 is pushed in, the movable housing 31 is moved upwardly to close the combustion chamber 3 as shown in FIG. 4; the gas fuel is injected into the combustion chamber 3, the gas fuel is then stirred and mixed with the air, and the thus mixed gas is ignited; the thus ignited mixed gas is combusted and exploded within the combustion chamber 3, so that the internal pressure within the combustion chamber 3 is increased suddenly; and, the thus increased pressure is applied from the space portion S through the openings 33*e* onto the upper end of the head valve 91, and the head valve 91 is thereby moved downwardly against the spring force of the spring 92 to open the opening 33*e* to the supply port 1*a*, whereby the combustion gas pressure is supplied into the striking cylinder 1 to drive the striking piston 2.

After end of the nail striking operation, the combustion gas within the striking cylinder 1 cools rapidly to reduce the pressure of the upper portion of the striking piston 2, whereby the head valve 91 is moved upwardly by the spring 92 to close the supply port 1*a*; and, at the same time, the check valve 90 is opened due to a difference in pressure between the upper and lower portions of the separation portion 11, so that the striking piston 2 is moved upwardly and is returned back to its original position. Since the pressure within the striking cylinder 1 is released from the penetration hole 11*a* into the combustion chamber 3, the striking piston 2 can be positively returned to the top dead center thereof. After then, the contact member 8 is moved downwardly and thus the movable housing 31 is also moved downwardly to thereby open the combustion chamber 3; and, the fresh air flows into the combustion chamber 3 from the opened upper O ring 31*a*, and the combustion gas is discharged from the lower exhaust port 1*b*.

And, for example, even when the return of the striking piston 2 after end of the nail striking operation is incomplete for some reason and the striking piston 2 is returned only halfway, owing to the check valve 90 of the separation portion 11 for separating the interior portion of the striking cylinder 1 and the interior portion of the combustion chamber 3 from each other, the capacity of the combustion chamber 3 cannot be expanded but can be held constant. This can prevent the fuel from becoming thin and thus can secure combustion based on a proper fuel density.

That is, the capacity of the combustion chamber 3 can be kept constant regardless of the position of the striking piston 2, and thus the mixed gas within the combustion chamber 3 can be held in a constant proper density; and, even when the striking piston 2 cannot return completely, a constant level of pressure can be applied to this striking piston 2 to thereby move it down to the bottom dead center thereof and thus, when the combustion gas cools, the striking piston 2 can be moved and returned to the top dead center thereof.

Also, when the air is supercharged into the combustion chamber 3 using a supercharger (not shown), although the pressure within the combustion chamber 3 is increased, such increased pressure is unable to open the head valve 91. That is, there is no possibility that the striking piston 2 can be moved downwardly due to the supercharged pressure.

The nailing machine according to the present embodiment can also provide similar operation effects to those of the nailing machine shown in FIG. 1.

And, since the sleeve 33 is interposed between the movable housing 31 of the combustion chamber 3 and head valve 91, and also since the movable housing 31 and head valve 91 are separated from each other by the sleeve 33 in such a manner that they are not connected directly with each other, when the movable housing 31 and head valve 91 move, they have no influence on each other. That is, the present embodiment can further provide a specific operation effect that the mutual interference movement between these two elements can be prevented.

Here, in the present embodiment, although the movable housing has been described as a movable housing which can be moved in the vertical direction, alternatively, the movable housing may also be structured such that it can be rotated to open and close the combustion chamber.

Third Exemplary Embodiment

Now, description will be given below of a third exemplary embodiment according to the invention with reference to FIGS. 5 to 8.

FIGS. 5 and 6 respectively show a gas internal combustion type nailing machine A. This nailing machine A includes: a nailing machine main body A1 for accommodating therein a drive mechanism portion, a gas fuel cartridge and the like; a grip A2 formed integrally with the nailing machine main body A1; a nose portion A3 having a mounting portion for mounting a magazine A4 projecting from the lower portion (in FIG. 5) of the nailing machine main body A1; and, other composing parts.

The drive mechanism portion to be accommodated into the nailing machine main body A1 includes: a cylindrical-shaped striking cylinder 1; a striking piston 2 which can be slid reciprocatingly in the vertical direction (in FIG. 5) within the striking cylinder 1; a combustion chamber 3 formed of a space which is surrounded by a tubular-shaped movable housing 31 and an upper cylinder head portion 32 respectively disposed upwardly of the striking cylinder 1 and also which is separated by the upper surface of the striking piston 2; a driver 4 fixed to the striking piston 2; a spark plug 5 mounted on the upper cylinder head portion 32 of the combustion chamber 3; a stirring fan 7 which, when it is driven by a motor M, can mix together combustible gas fuel supplied from a gas cartridge 6 and the air; and, other composing elements.

Also, there is further provided a contact member 8 which is used to carry out an initial operation to substantially start the drive mechanism portion. The contact member 8 is structured in the following manner. That is, in a state where the nailing machine is not applied to a nailing operation, the contact member 8 is urged by a spring in such a manner that the lower end 8*a* of the contact member 8 can be projected from the lower-most portion of the nose portion A3, the upper end 8*b* of a rod member connected to the contact member 8 is connected to the lower end portion of the movable housing 31 of the combustion chamber 3, whereby the movable housing 31 of the combustion chamber 3 is moved down to its lower position and an upper O ring 31*a* (which will be discussed later) for sealing the upper portion of the movable housing 31 is opened by the movable housing 31.

When the contact member 8 is pressed downwardly against a member to be driven, the contact member 8 is thereby pushed in upwardly relative to the nailing machine. Therefore, as shown in FIG. 6, the tubular-shaped movable housing 31 of the combustion chamber 3 is moved upwardly to seal and close the combustion chamber 3; and, at the same time, gas fuel is injected and supplied from the gas fuel cartridge 6 into the combustion chamber 3 through the fuel supply passage 51 of the cylinder head portion 32 situated upwardly of the combustion chamber 3, the air and gas fuel are stirred and mixed together by driving the stirring fan 7 disposed substantially in the central portion of the combustion chamber 3 in such a manner that they are mixed uniformly, and a trigger lever 9 is pushed in to turn on a trigger switch and thus ignite the spark plug 5, whereby the mixed gas within the combustion chamber 3 can be exploded and combusted.

The high combustion pressure resulting from the combustion of the mixed gas within the combustion chamber 3 acts onto the upper portion of the striking piston 2 to thereby move down the striking piston 2. As the striking piston 2 moves down, the driver 4 fixed to the striking piston 2 also moves down to strike the head portion of a nail fed from the magazine A4 into a penetration hole formed in the nose portion A3, whereby the nail can be struck into a given position of the member to be nailed.

Also, when the striking piston 2 moves down to the bottom dead center thereof, the temperature of the combustion gas expanded suddenly within the striking cylinder 1 lowers suddenly into a negative pressure; and, therefore, the striking piston 2 is moved up and returned back to the top dead center thereof.

And, just before or after the above-mentioned operation, the nailing operation is ended by releasing the operation of the trigger lever 9. With the end of the nailing operation, the contact member 8, which has been released from its pressed state against the member to be nailed, is pressed down by the return force of the spring and is thereby moved down. As the contact member 8 moves down, the movable housing 31 of the combustion chamber 3 also moves down to thereby, as shown in FIG. 5, open the housing 31 and the upper O ring 31*a* of the upper cylinder head portion 32 of the combustion chamber 3, thereby allowing the fresh air to flow into the combustion chamber 3.

That is, the gas internal combustion nailing machine A has a structure which is substantially the same as the above-mentioned structure.

Here, description will be given below in detail of the structure of the combustion chamber 3 with reference to FIGS. 5 and 6. That is, inside the movable housing 31 of the combustion chamber 3 which is surrounded by the tubular-shaped movable housing 31 and cylinder head portion 32, there is disposed a tubular-shaped sleeve 33 which is used to separate or divide the combustion chamber 3. Thus, inside the sleeve 33, there is formed an inside space portion 3*a* and, between the sleeve 33 and movable housing 31, there is formed a ring-shaped outside space portion 3*b*.

The sleeve 33 is made of a substantially straight tubular member which is extended from the upper end of the striking cylinder 1 and the inside diameter of which is set slightly larger than the inside diameter of the striking cylinder 1; and the upper end of the sleeve 33 is fitted with and fixed to a ring-shaped step portion 32*a* formed just below the upper O ring 31*a* of the cylinder head portion 32. Also, in the upper and lower portions of the peripheral wall of the sleeve 33, there are penetratingly formed communication portions 33*a* and 33*b* in two upper and lower stages through which the mixed gas is allowed to flow. And, the relatively wide peripheral surface of the peripheral wall intervening between the upper and lower two-stage communication portions 33*a* and 33*b* is disposed opposed to and close to the outer periphery of the rotary vane of the stirring fan 7.

Next, as shown in FIG. 7, of the upper communication portion 33*a* of the sleeve 33, a portion 36 disposed nearest to the above-mentioned spark plug is shielded. The block portion 36 may also employ a structure in which no opening is formed in this portion, or may also employ a structure in which the corresponding communication portion is covered with a proper seal member or the like.

The sleeve 33 is arranged concentrically with and is spaced by a given distance from the tubular-shaped movable housing 31 situated outside the sleeve 33, while the upper and lower outer peripheral walls of the sleeve 33 can be slidingly contacted with the upper and lower inner peripheral walls of the movable housing 31 respectively. Owing to this structure, when the movable housing 31 is guided by the sleeve 33, it can be operated stably in the vertical direction.

Also, the upper and lower O rings 31*a* and 31*b* respectively provided on the sleeve 33 made of a tubular member are formed substantially equal in diameter to each other and, therefore, the upper and lower sealing diameters of the movable housing 31 are substantially equal to each other.

Here, in the combustion chamber 3, on the upper end of the striking cylinder 1, there are provided a separation portion 11 for separating the interior portion of the striking cylinder 1 and the interior portion of the combustion chamber 3 from each other, and a check valve 90 which is used to open and close a penetration hole 11*a* formed in the separation portion 11.

The check valve 90 is made of a plate spring and is normally urged by a spring so as to close the interior portion of the striking cylinder 1 and the interior portion of the combustion chamber 3 with respect to each other and, only when the internal pressure of the striking cylinder 1 is higher than the internal pressure of the combustion chamber 3, the check valve 90 can open them with respect to each other.

The upper end of the sleeve 33 is fitted with and fixed to the ring-shaped step portion 32*a* of the cylinder head portion 32, while the lower inside fixed portion 33*c* of the sleeve 33 is fitted with and fixed to the outer periphery of the separation portion 11 fixed to the upper end of the striking cylinder 1. In correspondence to this, the annular space portion 3*a* formed inside the tubular-shaped movable housing 31 of the combustion chamber 3 is formed such that it is extended downwardly.

Next, in the upper end side walls of the striking cylinder 1, there are formed supply ports 1*a* and, in correspondence to this, in the downward extended portions 33*d* of the sleeve 33, there are opened up openings 33*e* respectively. And, between the striking cylinder 1 and sleeve 33, there is interposed a ring-shaped head valve 38 which can be moved in the vertical direction in such a manner that it allows the supply ports 1*a* and openings 33*e* to communicate with each other or it can cut off them from each other.

The head valve 38 is disposed to be movable in the vertical direction along the upper outside surface of the striking cylinder 1 and also along the inner peripheral surface of the extended portion 33*d* extended further downwardly from the lower inside fixed portion 33*c* of the sleeve 33. Also, the head valve 38 is normally urged upwardly by a spring 92 provided on the lower portion of the head valve 38 so as to close the supply port 1*a*. The spring force of the spring 92 is set to such a degree that, when the internal pressure of the combustion chamber 3 is increased due to combustion, it is unable to hold the head valve 38 in the closed state thereof.

Next, description will be given below of the operation of the above-mentioned nailing machine. When striking a nail, since the contact member 8 is pushed in, the movable housing 31 is moved upwardly to close the combustion chamber 3 as shown in FIG. 6, and the gas fuel is injected into the combustion chamber 3 and is stirred and mixed up with the air there.

In this case, since the peripheral wall of the sleeve 33 is disposed close to the rotary vane of the stirring fan 7, the mixed gas going outwardly in the diameter direction is shielded off by the fan 7 to thereby form a forced flow (see arrow marks shown in FIG. 6) going downwardly in the axial direction of the combustion chamber 3. Therefore, while positively catching the mixed gas stagnating in the vicinity of the lower rotation center of the fan 7, the forced-flow mixed gas flows out from the lower communication portion 33*b* of the sleeve 33 to the outside space portion 3*b* intervening between the sleeve 33 and movable housing 31, the mixed gas rises further upwardly within the space portion 3*b* and flows into the inside space portion 3*a* from the upper communication portion 33*a*, and the mixed gas again forms a flow which goes toward behind the rotary vane of the fan 7. Such flow of the mixed gas can accelerate the stirring and mixing of the air and gas fuel further and thus the uniform mixture of the mixed gas can be facilitated effectively in a short time.

And, the mixed gas is ignited by the spark plug 5 and is thus combusted, the internal pressure of the combustion chamber 3 is increased suddenly due to the resultant combustion pressure, the increased internal pressure is applied from space portions S1 and S2 into the upper end of the head valve 38 through the openings 33*e*, and the head valve 38 is thereby moved downward against the spring force of the spring 92 to open the openings 33*e* with respect to the supply ports 1*a*, whereby the combustion gas pressure is supplied into the striking cylinder 1 to drive the striking piston 2.

After end of the nailing operation, as shown in FIG. 5, since the combustion gas within the striking cylinder 1 cools down suddenly to thereby reduce the pressure of the upper portion of the striking piston 2, the head valve 38 is moved upward due to the spring force of the spring 92 to block off the supply ports 1*a*. At the same time, due to a difference between the pressures of the upper and lower portions of the separation portion 11, the check valve 90 is opened and the striking piston 2 is moved upward and returned to the upper position thereof, whereby the combustion gas is discharged from the upper discharge port 1*b*. Since the pressure within the striking cylinder 1 is released from the second opening 11*a* into the combustion chamber 3, the striking piston 2 can be positively moved up and returned to the top dead center thereof. After then, the contact member 8 is moved downward and, at the same time, the movable housing 31 is moved downward to open the combustion chamber 3, whereby the fresh air is allowed to flow the combustion chamber 3.

And, for example, even when the return of the striking piston 2 after end of the nail striking operation is incomplete for some reason and the striking piston 2 is returned only halfway, owing to the check valve 90 of the separation portion 11 for separating the interior portion of the striking cylinder 1 and the interior portion of the combustion chamber 3 from each other, the capacity of the combustion chamber 3 cannot be expanded but can be held constant. This can prevent the fuel from becoming thin and thus can secure combustion in a proper fuel density.

That is, the capacity of the combustion chamber 3 can be kept constant regardless of the position of the striking piston 2, and thus the mixed gas within the combustion chamber 3 can be held in a constant proper density; and, even when the striking piston 2 cannot return completely, a constant level of pressure can be applied to this striking piston 2 to thereby move it down to the bottom dead center thereof and thus, when the combustion gas cools, the striking piston 2 can be moved up and returned again to the top dead center thereof.

Also, when the air is supercharged into the combustion chamber 3 using a supercharger (not shown), although the pressure within the combustion chamber 3 is increased, such increased pressure is unable to open the head valve 91. That is, there is no possibility that the striking piston 2 can be moved downwardly due to the supercharged pressure.

As described above, since the sleeve 33 substantially formed as the extended portion of the striking cylinder 1 guides the vertical sliding movement of the movable housing 31 of the combustion chamber 3 using the upper and lower sliding portions of the peripheral wall of the sleeve 33, the movable housing 31 can be prevented from shifting in the axis thereof, the vertical movement of the movable housing 31 can be executed smoothly and positively, the operation load of the movable housing 31 can be reduced, and the poor sealing of the movable housing 31 by the O rings 31*a* and 31*b* can be prevented effectively.

Also, since the sleeve 33 is made of a substantially straight tubular-shaped member and thus the upper and lower O rings 31*a* and 31*b* of the movable housing 31 of the combustion chamber 3 are equal in diameter to each other, a load, which is generated due to the seal diameter difference that can be caused by a combustion pressure at the time when the mixed gas is combusted within the combustion chamber, can be prevented from being generated with respect to the movable housing 31. Therefore, for example, when a mechanism for applying a supercharging pressure is provided within the combustion chamber, it is possible to prevent the occurrence of an unfavorable phenomenon that a partial load is generated in the movable housing 31 due to the influence of the supercharged pressure to thereby leave the movable housing 31 at the upper position thereof after it is moved there, and also the occurrence of an inconvenience that the movable housing 31 cannot be opened.

And, the mixed gas, which has been forcibly blown out downwardly due to the rotation of the fan 7, moves from the lower communication portion 33*b* of the sleeve 33 to the outside space portion 3*b*, rises further upwardly and flows again from the upper communication portion 33*a* into the inside space portion 3*a* to thereby form a flow which goes toward behind the rotary vane of the fan 7. As a result of this, the air and gas fuel can be stirred and mixed well, thereby being able to prevent the incomplete combustion of the mixed gas and thus to enhance the combustion efficiency thereof.

Next, since the block portion 36 is arranged in the portion of the upper communication portion 33*a* that exists nearest to the spark plug 5, as described above, when, after the mixed gas is moved from the lower communication portion 33*b* of the sleeve 33 to the outside space portion S2 due to the rotation of the fan 7, it moves upwardly and flows from the upper communication portion 33*a* into the inside space portion S1, the speed of the mixed gas is increased; however, since the block portion 36 is formed in the vicinity of the spark plug 5, the speed of the mixed gas is reduced in this portion. Therefore, the mixed gas can be ignited positively by the spark plug 5, which can enhance the ignition performance of the mixed gas. Also, the block portion 36 may be formed in the sleeve 33, which eliminates the need to form the block portion 36 separately from the sleeve 33.

Also, since the sleeve 33 intervenes between the movable housing 31 of the combustion chamber 3 and head valve 38 and also since the movable housing 31 and head valve 38 are separated from each other by the sleeve 33 used as a fixed member in such a manner that they are not contacted with each other directly, the movable housing 31 and head valve 38 can be prevented from interfering with each other while they are moving. That is, according to the present embodiment, there can also be provided a specific operation effect that the mutually influenced movements of the movable housing 31 and head valve 38 can be prevented.

Here, the invention is not limited to a structure in which a movable housing and a head valve are movable in the vertical direction. For example, the invention can also be applied to a structure in which they can be opened and closed by rotating them.

Although the invention has been described heretofore in detail or with reference to the specific embodiments thereof, it is obvious to those skilled in the art that various changes and modifications are also possible without departing from the spirit and scope of the invention.

The present patent application is based on the Japanese Patent Application (Application No. 2007-096165) filed on Apr. 2, 2007 and the Japanese Patent Application (Application No. 2007-118818) filed on Apr. 27, 2007 and contents thereof are incorporated herein by reference.

INDUSTRIAL APPLICABILITY

The invention can be applied to a gas internal combustion type nailing machine for striking a nail such as an ordinary nail and a drive screw.

The invention claimed is:

1. A gas internal combustion type nailing machine, comprising:

a striking cylinder for slidably accommodating a striking piston therein;

a tubular-shaped housing that is movable relative to a main body of the nailing machine;

a combustion chamber disposed in an upper side of the striking cylinder and configured to be opened and closed by the housing;

a fan disposed in a central portion of the combustion chamber;

a tubular-shaped sleeve interposed between the housing and the fan, and fixed to the main body of the nailing machine; and communication holes respectively provided through portions of a peripheral wall of the sleeve in an upper side and a lower side of the fan, and configured to communicate the combustion chamber with an annular space portion formed between the housing and the sleeve the annular space portion defining a flow path from the communication hole provided at the lower side of the fan to the communication hole provided at the upper side of the fan.

2. The gas internal combustion type nailing machine according to claim 1, wherein the tubular-shaped sleeve of the combustion chamber is disposed adjacent to a rotary vane of the fan.

3. The gas internal combustion type nailing machine according to claim 1, wherein the sleeve is configured to guide the housing.

4. The gas internal combustion type nailing machine according to claim 1, wherein upper and lower sealing diameters of the housing are substantially equal to each other.

5. The gas internal combustion type nailing machine according to claim 1, wherein a portion of a communication hole which is nearest to the spark plug is shielded.

6. A gas internal combustion type nailing machine, comprising:

a striking cylinder for slidably accommodating a striking piston therein;

a tubular-shaped housing that is movable relative to a main body of the nailing machine;

a combustion chamber disposed in an upper side of the striking cylinder and configured to be opened and closed by the housing;

a fan disposed in a central portion of the combustion chamber;

a tubular-shaped sleeve interposed between the housing and the fan, and fixed to the main body of the nailing machine;

communication portions respectively provided on portions of the sleeve in an upper side and a lower side of the fan, and configured to communicate the combustion chamber with an annular space portion formed between the housing and the sleeve;

a separation portion formed between the combustion chamber and the striking cylinder and including a valve that is configured to close when a pressure on a side of the combustion chamber is high and open when a pressure on a side of the striking cylinder high;

a downward extended portion formed in an lower portion of the sleeve and extending downwardly of the separation portion;

an opening formed in the downward extended portion and situated at a position corresponding to a supply port formed in an upper end side wall of the striking cylinder; and a ring-shaped head valve that is vertically movable between the striking cylinder and the downward extended portion of the sleeve and configured to open and close the supply port and the opening, wherein the head valve is urged in a closing direction and is opened by a combustion pressure of a mixed gas in the combustion chamber.

* * * * *